US010150646B2

(12) United States Patent
Koba et al.

(10) Patent No.: US 10,150,646 B2
(45) Date of Patent: Dec. 11, 2018

(54) ELEVATOR DEVICE INCLUDING EVACUATION OPERATION MODE REQUEST SWITCH

(71) Applicant: MITSUBISHI ELECTRIC CORPORATION, Chiyoda-ku (JP)

(72) Inventors: Yoshimasa Koba, Tokyo (JP); Shinichi Kuroda, Tokyo (JP); Takaharu Ueda, Veenendaal (NL); Ashiqur Rahman, Veenendaal (NL); David Willem Lodewijk Offerhaus, Veenendaal (NL)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 380 days.

(21) Appl. No.: 15/022,312

(22) PCT Filed: Sep. 17, 2013

(86) PCT No.: PCT/JP2013/075020
§ 371 (c)(1),
(2) Date: Mar. 16, 2016

(87) PCT Pub. No.: WO2015/040669
PCT Pub. Date: Mar. 26, 2015

(65) Prior Publication Data

US 2016/0280510 A1 Sep. 29, 2016

(51) Int. Cl.
*B66B 1/20* (2006.01)
*B66B 5/02* (2006.01)

(52) U.S. Cl.
CPC ..... *B66B 5/021* (2013.01)

(58) Field of Classification Search
CPC ..... B66B 5/021
(Continued)

(56) References Cited

U.S. PATENT DOCUMENTS 4,482,032 A * 11/1984 Enriquez ..... B66B 1/468 187/392
5,086,450 A * 2/1992 Kitagawa ..... H04M 11/04 187/390
(Continued)

FOREIGN PATENT DOCUMENTS

EP 1 930 279 A1 6/2008
JP 2003-276964 A 10/2003
(Continued)

OTHER PUBLICATIONS

International Preliminary Report on Patentability and Written Opinion dated Mar. 31, 2016 in PCT/JP2013/075020 filed Sep. 17, 2013 (submitting English translation only).
(Continued)

*Primary Examiner* — Anthony Salata
(74) *Attorney, Agent, or Firm* — Oblon, McClelland, Maier & Neustadt, L.L.P.

(57) ABSTRACT

An elevator device enabling efficient evacuation of people left in a building is provided. The elevator device includes: an evacuation operation mode request switch provided in a hall of an elevator on a rescue floor; a car that if the evacuation operation mode request switch is kept in an operated state, keeps operating in an evacuation operation mode in which the car moves between the rescue floor and an evacuation floor; and an operation control device that is provided in the hall of the elevator on the rescue floor, and if the operation control device is operated when the car is stopped at the rescue floor, moves the car to the evacuation floor.

9 Claims, 10 Drawing Sheets

(58) Field of Classification Search
USPC ..... 187/247, 277, 288, 293, 380–388, 391, 187/393
See application file for complete search history.

(56) References Cited

U.S. PATENT DOCUMENTS

| | | | | | |
|---|---|---|---|---|---|
| 5,345,046 | A * | 9/1994 | Rynaski | B66B 5/0031 | 187/390 |
| 5,386,463 | A * | 1/1995 | Thompson | H04M 1/00 | 379/182 |
| 6,971,480 | B2 * | 12/2005 | Trifu | B66B 3/00 | 187/247 |
| 7,210,564 | B2 * | 5/2007 | Kawai | B66B 5/024 | 187/313 |
| 7,464,793 | B2 * | 12/2008 | Komatsu | B66B 1/34 | 187/290 |
| 7,677,363 | B2 * | 3/2010 | Kawai | B66B 5/021 | 187/313 |
| 8,109,368 | B2 * | 2/2012 | Manabe | B66B 5/024 | 187/384 |
| 8,245,819 | B2 * | 8/2012 | Hikita | B66B 5/024 | 187/314 |
| 8,251,185 | B2 * | 8/2012 | Manabe | B66B 5/024 | 187/313 |
| 8,763,761 | B2 * | 7/2014 | Siikonen | B66B 5/021 | 187/384 |
| 8,839,914 | B2 * | 9/2014 | Iwata | B66B 5/024 | 187/384 |
| 2010/0213011 | A1 | 8/2010 | Hikita et al. | | |
| 2017/0313551 | A1 * | 11/2017 | Nakari | B66D 5/30 | |
| 2017/0320705 | A1 * | 11/2017 | Honda | B66B 1/28 | |

FOREIGN PATENT DOCUMENTS

| | | | |
|---|---|---|---|
| JP | 2005-126155 | A | 5/2005 |
| JP | 2009-234778 | A | 10/2009 |
| JP | 2011-126613 | A | 6/2011 |
| JP | 2012-176813 | A | 9/2012 |
| JP | 2013-10579 | A | 1/2013 |
| JP | 2013-52935 | A | 3/2013 |
| KR | 10-2007-0024542 | A | 3/2007 |
| WO | WO 2006/085386 | A1 | 8/2006 |
| WO | 2007/037031 | A1 | 4/2007 |
| WO | 2009/047843 | A1 | 4/2009 |
| WO | 2013/001643 | A1 | 1/2013 |

OTHER PUBLICATIONS

Office Action dated Feb. 4, 2017 in Chinese Application No. 201380079621.7 (with partial English language translation).
Korean Office Action dated Oct. 31, 2017 in Korean Patent Application No. 10-2016-7009629 (with English translation).
International Search Report dated Dec. 3, 2013 in PCT/JP2013/075020 filed Sep. 17, 2013.
Japanese Office Action dated Aug. 25, 2015 in JP 2015-524540 filed May 13, 2015 (with partial English translation) (6 pages).
Japanese Office Action dated Jan. 5, 2016 in JP 2015-524540 filed May 13, 2015 (with partial English translation) (5 pages).

* cited by examiner

FIG. 6

| Running mode | Normal, NF | Alarm | Fire Warden | Call back |
|---|---|---|---|---|
| No-entry | Off | On | Off | On |
| EV-sign1 | Off | On | On | Off |
| EV-sign2 | Off | On | On | Off |
| EV-sign3 | Off | On | On | Off |
| Intercom | Normal com. | Normal com. | Evacuation com. | Evacuation com. |

ELEVATOR DEVICE INCLUDING EVACUATION OPERATION MODE REQUEST SWITCH

TECHNICAL FIELD

The present invention relates to an elevator device.

BACKGROUND ART

For example, Patent Literature 1 describes an elevator device. In the elevator device, rescue floors and an evacuation floor are set. In an evacuation operation mode, a car moves between a rescue floor and the evacuation floor. In this case, the car responds to a call from a rescue floor on which a call input device for specific persons has been operated. Thus, a user can preferentially be evacuated from the rescue floor on which the call input device for specific persons has been operated.

CITATION LIST

Patent Literature

Patent Literature 1: International Publication No. WO2009/047843
Patent Literature 2: International Publication No. WO2007/037031
Patent Literature 3: International Publication No. WO2013/001643

SUMMARY OF INVENTION

Technical Problem

However, the art described in Patent Literature 1 is one premised on evacuation of a user that has operated a call input device for specific persons. Thus, this is inefficient when a large number of users are evacuated from the rescue floor.

The present invention has been made in order to solve the aforementioned problem. An object of the present invention is to provide an elevator device that enables efficient evacuation of people left in a building.

Means for Solving the Problems

An elevator device of the invention includes an evacuation operation mode request switch provided in a hall of an elevator on a rescue floor, a car that if the evacuation operation mode request switch is kept in an operated state, keeps operating in an evacuation operation mode in which the car moves between the rescue floor and the evacuation floor and an operation control device that is provided in the hall of the elevator on the rescue floor, and if the operation control device is operated when the car is stopped at the rescue floor, moves the car to the evacuation floor.

Advantageous Effect of Invention

The present invention enables effective evacuation of people left in a building.

BRIEF DESCRIPTION OF THE DRAWINGS

FIG. 6 is a diagram for describing statuses of no-entry indicators, etc., in the elevator device according to Embodiment 1 of the present invention.

DESCRIPTION OF EMBODIMENT

Figure 1:
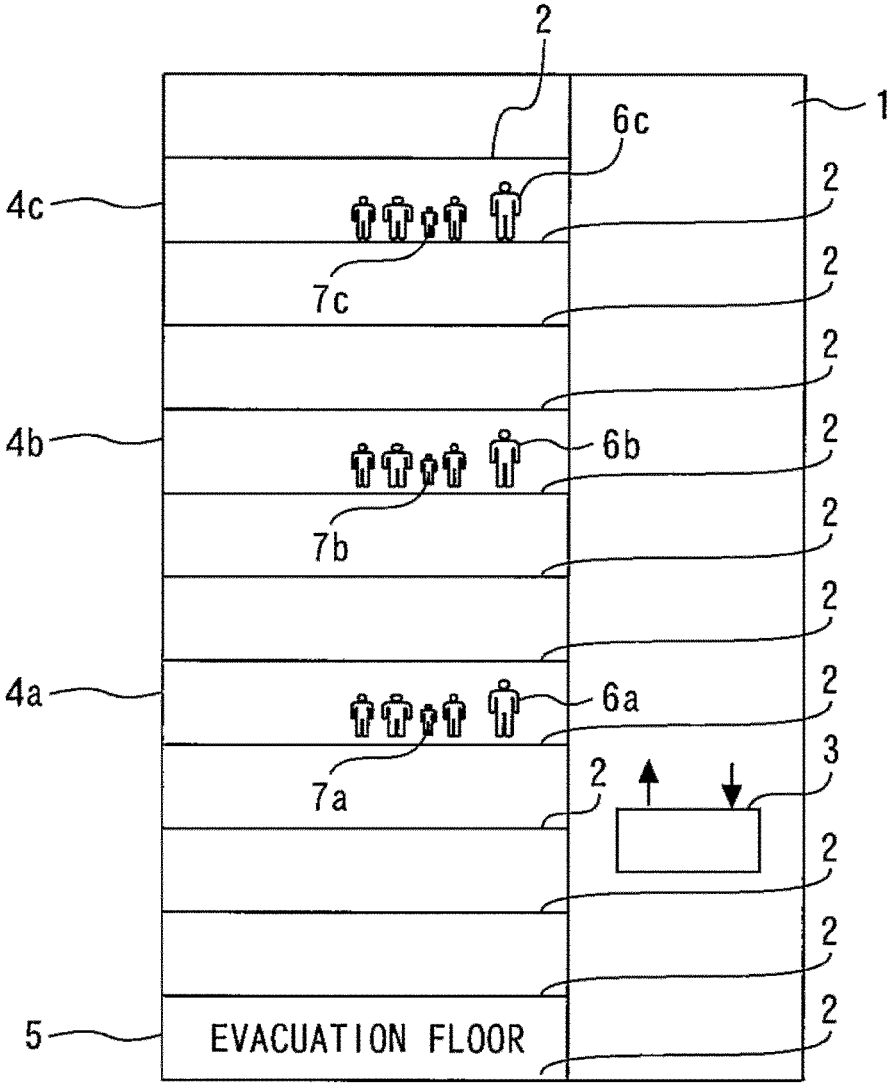
FIG. 1 is a diagram of a configuration of a building using an elevator device according to Embodiment 1 of the present invention.

An embodiment of the present invention will be described with reference to the attached drawings. In the drawings, parts that are identical or correspond to each other are provided with a same reference numeral. Overlapping description thereof will arbitrarily be simplified or omitted.

Embodiment 1

FIG. 1 is a diagram of a configuration of a building using an elevator device according to Embodiment 1 of the present invention.

In FIG. 1, in the building, a plurality of floors is provided. For example, in the building, first to twelfth floors are provided. In the building, a hoistway 1 of an elevator is provided. The hoistway 1 extends through each floor of the building. On each floor of the building, a hall 2 of the elevator is provided. Each hall 2 faces the hoistway 1. Inside the hoistway 1, a car 3 of the elevator is provided.

For example, in the building, three rescue floors are set in advance. For example, a fifth floor is set as a rescue floor 4*a*. For example, an eight floor is set as a rescue floor 4*b*. For example, an eleventh floor is set as a rescue floor 4*c*. For example, in the building, one evacuation floor 5 is set in advance. For example, the first floor, which is a bottom floor, is set as the evacuation floor 5.

In the building, upon occurrence of a disaster such as a fire, evacuation from the building is necessary. In this case, an evacuation guide member 6*a* promptly rushes to the hall 2 of the rescue floor 4*a* the evacuation guide member 6*a* is in charge of. An evacuation guide member 6*b* promptly rushes to the hall 2 of the rescue floor 4*b* the evacuation guide member 6*b* is in charge of. An evacuation guide member 6*c* promptly rushes to the hall 2 on the rescue floor 4*c* the evacuation guide member 6*c* is in charge of.

The evacuation guide member 6*a* guides evacuees 7*a* to evacuate to the evacuation floor 5 using the car 3. The evacuation guide member 6*b* guides evacuees 7*b* to the evacuation floor 5 using the car 3. The evacuation guide member 6*c* guides evacuees 7*c* to the evacuation floor 5 using the car 3.

Next, the halls 2 on the rescue floors 4*a* to 4*c* will be described with reference to FIG. 2.

Figure 2:
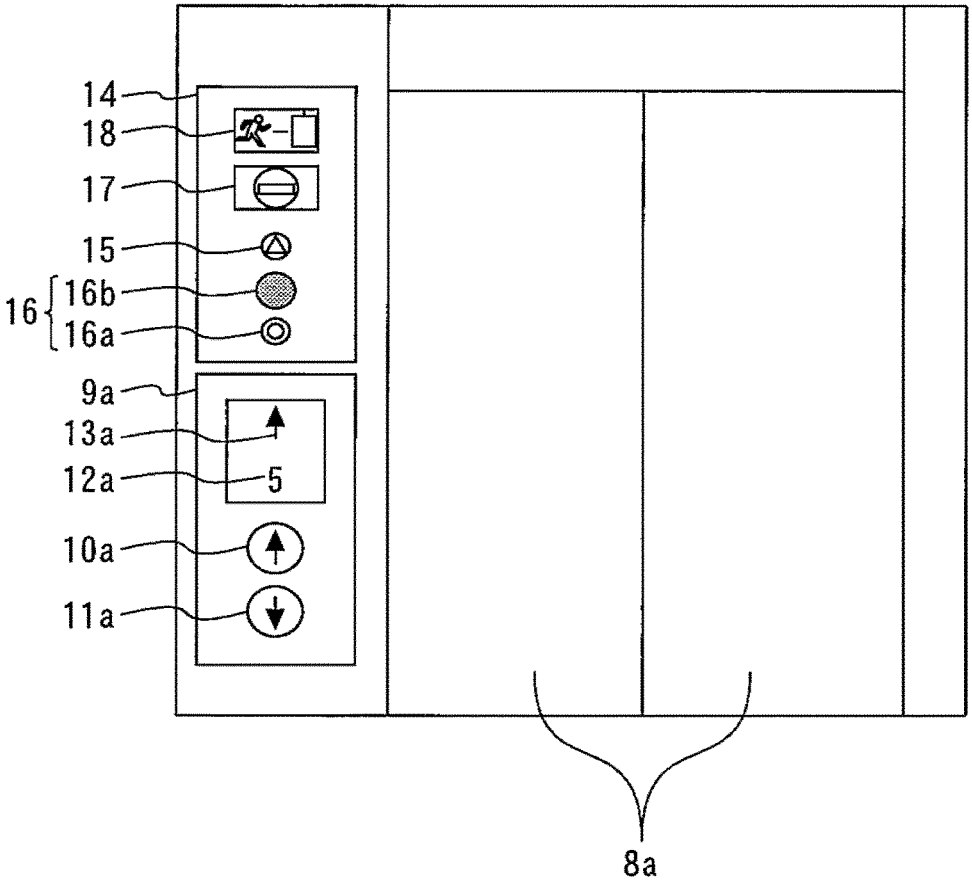
FIG. 2 is a front view of a hall on a rescue floor using the elevator device according to Embodiment 1 of the present invention.

FIG. 2 is a front view of a hall on a rescue floor using the elevator device according to Embodiment 1 of the present invention.

As illustrated in FIG. 2, doors 8*a* are provided at an entrance of the hall 2. On one side of the entrance of the hall 2, a hall operating panel 9*a* is provided. In a lower portion of the hall operating panel 9*a*, operation buttons are provided. The operation buttons include an up button 10*a* and a down button 11*a*. In an upper portion of the hall operating panel 9*a*, a position indicator 12*a* and a movement direction indicator 13*a* are provided. The position indicator 12*a* indicates a position of the car 3. The movement direction indicator 13*a* indicates a direction of movement of the car 3.

Above the hall operating panel 9*a*, an evacuation guidance operating panel 14 is provided. The evacuation guidance operating panel 14 includes an evacuation operation mode request switch 15, a report device 16, a no-entry indicator 17 and an evacuation guidance indicator 18.

The evacuation operation mode request switch 15 is provided at a center of the evacuation guidance operating panel 14. The report device 16 is provided below the evacuation operation mode request switch 15. The report device 16 includes an intercommunication button 16*a* and a speaker microphone 16*b*. The no-entry indicator 17 is provided above the evacuation operation mode request switch 15. The evacuation guidance indicator 18 is provided above the no-entry indicator 17.

The hall operating panel 9*a* and the evacuation guidance operating panel 14 are connected to a non-illustrated controller.

Next, the hall 2 on the evacuation floor 5 will be described with reference to FIG. 3.

Figure 3:
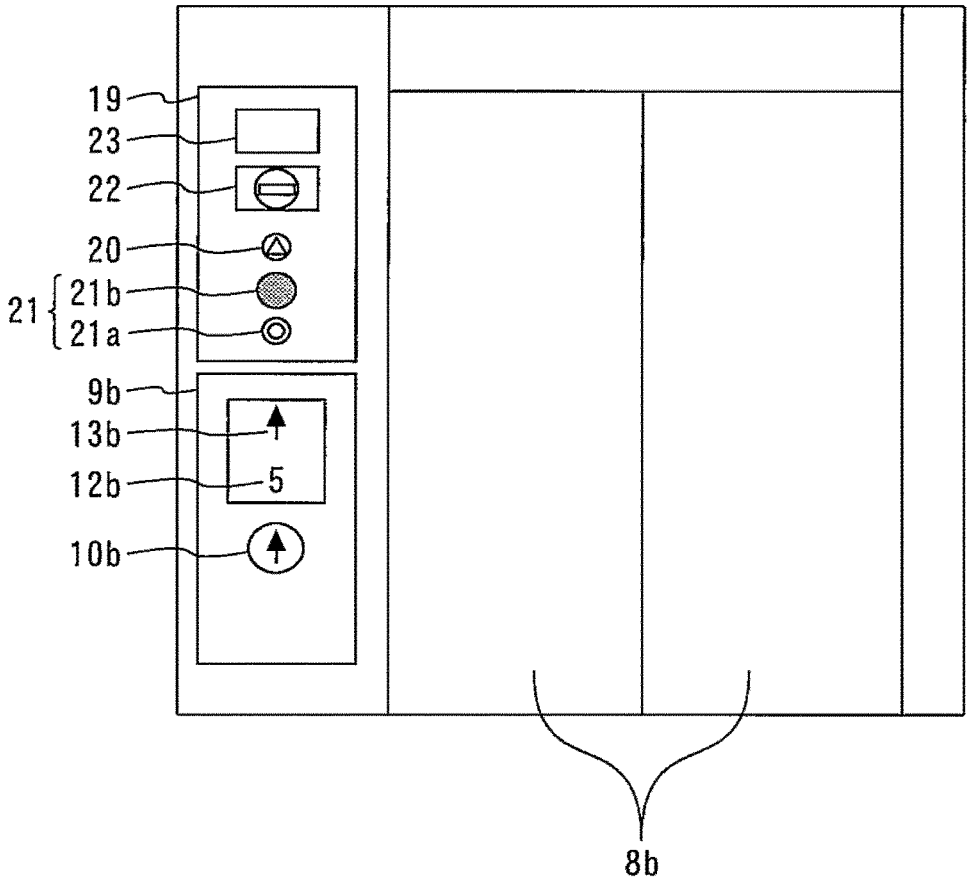
FIG. 3 is a front view of a hall on an evacuation floor using the elevator device according to Embodiment 1 of the present invention.

FIG. 3 is a front view of a hall on an evacuation floor using the elevator device according to Embodiment 1 of the present invention.

As illustrated in FIG. 3, doors 8*b* are provided at an entrance of the hall 2. On one side of the entrance of the hall 2, a hall operating panel 9*b* is provided. In a lower portion of the hall operating panel 9*b*, an operation button is provided. The operation button includes an up button 10*b*. In an upper portion of the hall operating panel 9*b*, a position indicator 12*b* and a movement direction indicator 13*b* are provided. The position indicator 12*b* indicates a position of the car 3. The movement direction indicator 13*b* indicates a direction of movement of the car 3.

Above the hall operating panel 9*b*, an operating panel 19 for firefighters is provided. The operating panel 19 for firefighters includes a forced return operation mode request switch 20, a report device 21, a no-entry indicator 22 and a use state indicator 23.

The forced return operation mode request switch 20 is provided at a center of the operating panel 19 for firefighters. The report device 21 is provided below the forced return operation mode request switch 20. The report device 21 includes an intercommunication button 21*a* and a speaker microphone 21*b*. The no-entry indicator 22 is provided above the forced return operation mode request switch 20. The use state indicator 23 is provided above the no-entry indicator 22.

The hall operating panel 9*b* and the operating panel 19 for firefighters are connected to the non-illustrated controller.

For each of the halls 2 of floors other than the rescue floors 4*a* to 4*c* and the evacuation floor 5, a prohibition indicator that is equivalent to the no-entry indicators 17 and 22 is provided. In each of the halls 2, a hall operating panel that is equivalent to the hall operating panels 9*a* and 9*b* is provided.

Next, the inside of the car 3 will be described with reference to FIG. 4.

Figure 4:
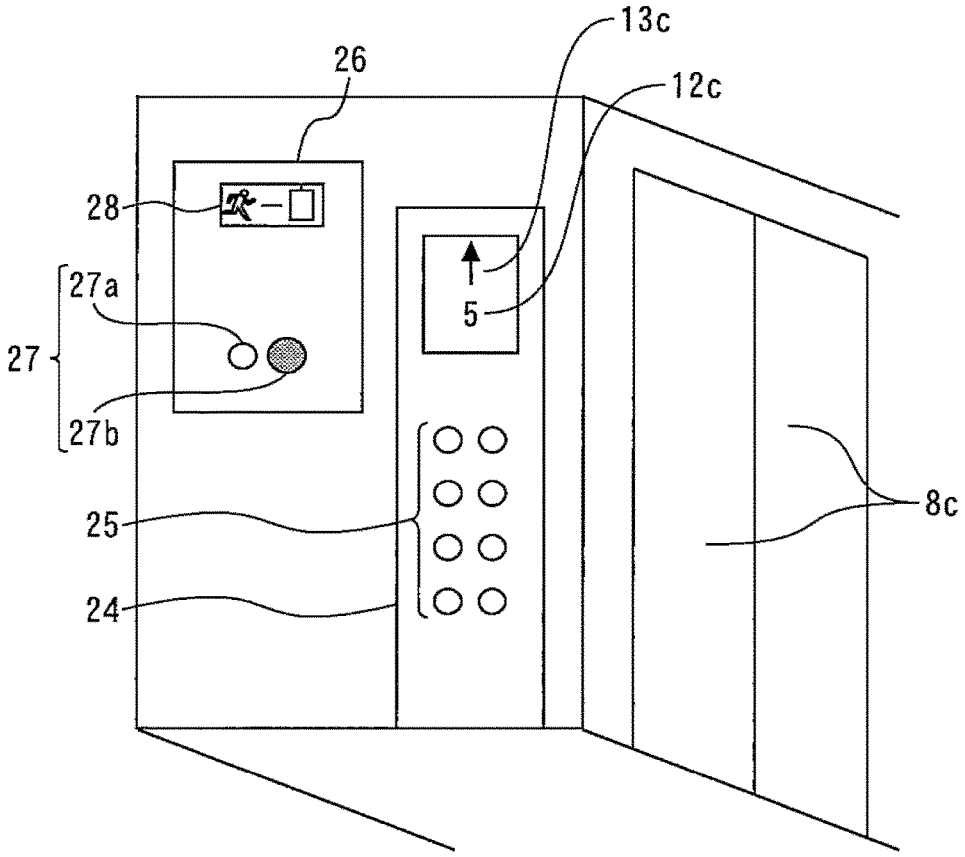
FIG. 4 is a perspective view of the inside of the car in the elevator device according to Embodiment 1 of the present invention.

FIG. 4 is a perspective view of the inside of the car in the elevator device according to Embodiment 1 of the present invention.

As illustrated in FIG. 4, doors 8*c* are provided at an entrance of the car 3. At a side wall of one side of the car 3, a car operating panel 24 is provided. In a lower portion of the car operating panel 24, operation buttons 25 are provided. In an upper portion of the car operating panel 24, a position indicator 12*c* and a movement direction indicator 13*c* are provided. The position indicator 12*c* indicates a position of the car 3. The movement direction indicator 13*c* indicates a direction of movement of the car 3.

At the side wall on the one side of the car 3, a communication device 26 is provided. The communication device 26 is provided on the back side of the car 3 relative to the car operating panel 24. In a lower portion of the communication device 26, a report device 27 is provided. The report device 27 includes an intercommunication button 27*a* and a speaker microphone 27*b*. In an upper portion of the communication device 26, an evacuation guidance indicator 28 is provided.

The car operating panel 24 and the communication device 26 are connected to the non-illustrated controller.

Next, operation modes of the elevator device will be described with reference to FIG. 5.

Figure 5:
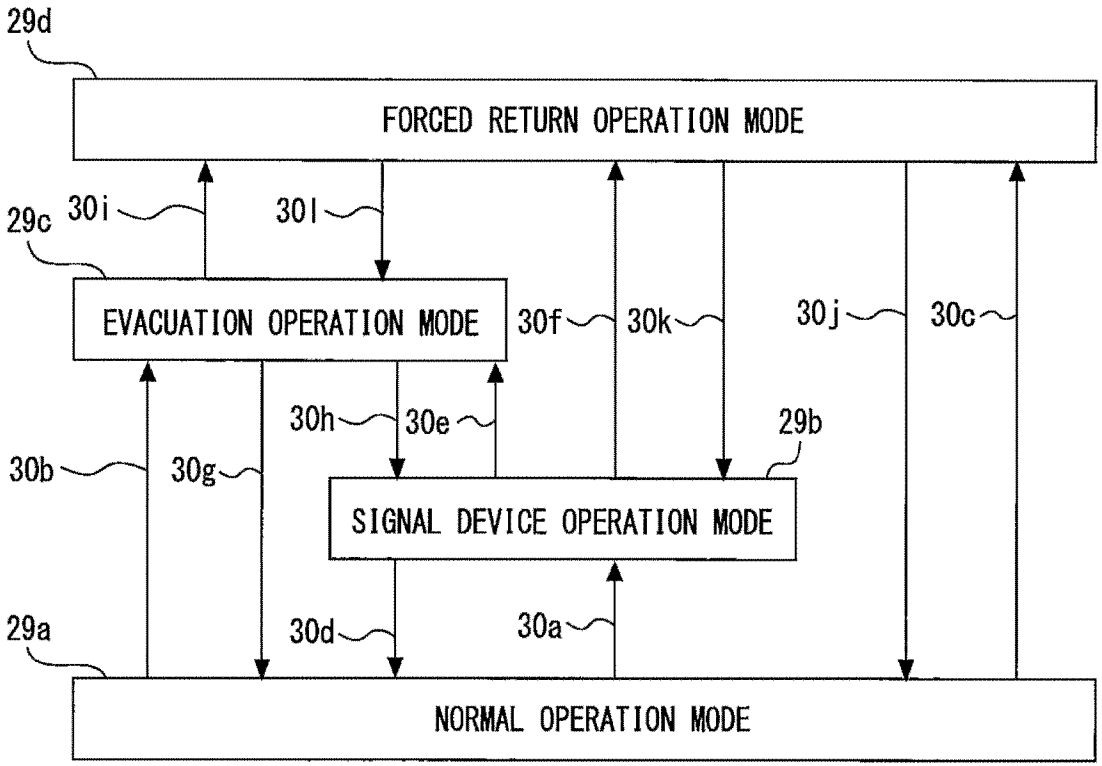
FIG. 5 is a diagram for operation modes of the elevator device according to Embodiment 1 of the present invention.

FIG. 5 is a diagram for operation modes of the elevator device according to Embodiment 1 of the present invention.

In FIG. 5, block 29*a* corresponds to a normal operation mode. Block 29*b* corresponds to a signal device operation mode. Block 29*c* corresponds to an evacuation operation mode. Block 29*d* corresponds to a forced return operation mode. For example, an operation mode transitions on the basis of a status of detection by a signal device, a status of the evacuation operation mode request switches 15 and a status of the forced return operation mode request switch 20.

For example, the signal device detects a state in which evacuation is needed because of, e.g., a fire. For example, an evacuation operation mode request switch 15 outputs a signal corresponding to an evacuation operation mode request to the controller when the evacuation operation mode request switch 15 is operated via, e.g., a key carried by e.g., the evacuation guide member 6*a*. For example, the forced return operation mode request switch 20 outputs a signal corresponding to a forced return operation mode request when the forced return operation mode request switch 20 is operated via, e.g., a key carried by a firefighter.

In FIG. 5, arrow 30*a* indicates that the operation mode transitions from the normal operation mode to the signal device operation mode. Arrow 30*b* indicates that the operation mode transitions from the normal operation mode to the evacuation operation mode. Arrow 30*c* indicates that the operation mode transitions from the normal operation mode to the forced return operation mode.

Arrow 30*d* indicates that the operation mode transitions from the signal device operation mode to the normal operation mode. Arrow 30*e* indicates that the operation mode transitions from the signal device operation mode to the evacuation operation mode. Arrow 30*f* indicates that the operation mode transitions from the signal device operation mode to the forced return operation mode.

Arrow 30*g* indicates the operation mode transitions from the evacuation operation mode to the normal operation mode. Arrow 30*h* indicates that the operation mode transitions from the evacuation operation mode to the signal device operation mode. Arrow 30*i* indicates that the operation mode transitions from the evacuation operation mode to the forced return operation mode.

Arrow 30*j* indicates that the operation mode transitions from the forced return operation mode to the normal operation mode. Arrow 30*k* indicates that the operation mode transitions from the forced return operation mode to the signal device operation mode. Arrow 30*l* indicates that the operation mode transitions from the forced return operation mode to the evacuation operation mode.

In a normal operation mode, a user on a hall 2 presses an operation button according to a direction that the user wishes to move. For example, the user presses the up button 10*a* if the user wishes to move to an upper floor. For example, the user presses the down button 11*a* if the user wishes to move to a lower floor. Here, the controller moves the car 3 to the floor on which the hall 2 in which the relevant operation has been performed exists. Subsequently, the controller opens the doors 8*c*, etc. Consequently, the user can get on the car 3. Subsequently, the user designates a destination floor via an operation button 25 on the car operating panel 24. The controller moves the car 3 to the destination floor. Subsequently, the controller opens the doors 8*c*, etc. Consequently, the user can get out of the car 3.

In a signal device operation mode, the controller does not respond to car calls. In this case, the controller forcibly moves the car 3 to the evacuation floor 5. Upon arrival of the car 3 to the evacuation floor 5, the controller opens the doors 8*b* and 8*c* for a preset period of time. Here, the controller guides users in the car 3 to the outside of the car 3. For example, the controller guides the users in the car 3 to the outside of the car 3 by means of an announcement. For example, the controller guides the users in the car 3 to the outside of the car 3 by means of chiming. For example, the controller guides the user in the car 3 to the outside of the car 3 by means of temporarily turning off lighting in the car 3. Subsequently, after a lapse of the preset period of time, the controller closes the doors 8*b* and 8*c*.

In an evacuation operation mode, the controller does not respond to car calls. In this case, the controller forcibly moves the car 3 to the evacuation floor 5. Upon arrival of the car 3 to the evacuation floor 5, the controller opens the doors 8*b* and 8*c* for a preset period of time. Here, the controller guides users in the car 3 to the outside of the car 3. For example, the controller guides the users in the car 3 to the outside of the car 3 by means of an announcement. For example, the controller guides the users in the car 3 to the outside of the car 3 by means of chiming. For example, the controller guides the users in the car 3 to the outside of the car 3 by temporarily turning off the lighting in the car 3. Subsequently, after a lapse of the preset period of time, the controller closes the doors 8*b* and 8*c*.

Subsequently, the controller moves the car 3 to the rescue floor on which the evacuation operation mode request switch 15 has been operated (for example, the rescue floor 4*a*). Upon arrival of the car 3 to the rescue floor, the controller opens the doors 8*a* and 8*c*. Here, the evacuation guide member of the rescue floor (for example, the evacuation guide member 6*a*) guides evacuees (for example, the evacuees 7*a*) to the inside of the car 3.

Here, the operation buttons in the hall 2 on the rescue floor function as an operation control device. For example, upon the evacuation guide member pressing an operation button in the hall 2, the controller closes the doors 8*a* and 8*c*. After that, the car 3 does not respond to car calls. Subsequently, the controller forcibly moves the car 3 to the evacuation floor 5. Upon arrival of the car 3 to the evacuation floor 5, the controller opens the doors 8*b* and 8*c* for a preset period of time. Here, the controller guides the users in the car 3 to the outside of the car 3. For example, the controller guides the users in the car 3 to the outside of the car 3 by means of an announcement. For example, the controller guides the users in the car 3 to the outside of the car 3 by means of chiming. For example, the controller guides the users in the car 3 to the outside of the car 3 by means of temporarily turning off the lighting in the car 3. Subsequently, after a lapse of the preset period of time, the controller closes the doors 8*b* and 8*c*.

Subsequently, the controller moves the car 3 to the rescue floor on which the evacuation operation mode request switch 15 has been operated (for example, the rescue floor 4*a*) again. The movement between the rescue floor and the evacuation floor 5 continues until the operated state of the evacuation operation mode request switch 15 on the rescue floor is cancelled.

Here, e.g., the position indicator 12*a* of each hall 2 functions as a rescue floor indicator. In this case, e.g., the position indicator 12*a* of each hall 2 indicates a floor number of the rescue floor on which the evacuation operation mode request switch 15 has been operated. The floor number of the rescue floor on which the evacuation operation mode request switch 15 has been operated may be indicated by, e.g., the position indicator 12*a* and the like only in the hall 2 on each of the rescue floors 4*a* to 4*c* and the hall 2 on the evacuation floor 5. If the car 3 is moving, e.g., the movement direction indicator 13*a* in each hall 2 indicates a direction of the movement of the car 3.

Upon the evacuation guide member cancelling the operated state of the evacuation operation mode request switch 15 on the rescue floor, the car stops moving between the rescue floor and the evacuation floor 5. If an evacuation operation mode request switch 15 is subsequently operated on a rescue floor that is different from the rescue floor, the controller executes an evacuation operation mode that is different from the evacuation operation mode. More specifically, the controller executes an evacuation operation mode in which the car 3 moves between the rescue floor on which the evacuation operation mode request switch 15 has been operated and the evacuation floor.

For a priority order of the rescue floors, it is possible that an order of each evacuation operation mode request switch 15 being operated is stored in a memory and the priority order is set on the basis of the order. It is also possible that after end of an evacuation operation mode for one rescue floor, an evacuation operation mode is preferentially set for a higher rescue floor. It is also possible that after end of an evacuation operation mode for one rescue floor, an evacuation operation mode is preferentially set for a lower rescue floor. An evacuation operation mode may preferentially be set for a rescue floor requiring more time for evacuation. More specifically, an evacuation operation mode may preferentially be set for a rescue floor that is farther from the evacuation floor 5.

In a forced return operation mode, the controller forcibly moves the car 3 to the evacuation floor 5. Upon arrival of the car 3 to the evacuation floor 5, the controller opens the doors 8*b* and 8*c* for a preset period of time. Here, the controller guides users in the car 3 to the outside of the car 3. For example, the controller guides the users in the car 3 to the outside of the car 3 by means of an announcement. For example, the controller guides the users in the car 3 to the outside of the car 3 by means of chiming. For example, the controller guides the users in the car 3 to the outside of the car 3 by temporarily turning off the lighting in the car 3.

Next, statuses of the no-entry indicators 17 and 22, etc., will be described with reference to FIG. 6.

FIG. 6 is a diagram for describing statuses of no-entry indicators, etc., in the elevator device according to Embodiment 1 of the present invention.

In FIG. 6, "Running mode" indicates operation modes. "No-entry" indicates status of the no-entry indicators 17 and 22. "EV-sign 1" indicates a status of the evacuation guidance indicators 18. "EV-sign 2" indicates a status of the evacuation guidance indicator 28. "EV-sign 3" indicates a status of the use state indicator 23. "Intercom" indicates a status of the report devices 16, 21 and 27.

A status in a normal operation mode and a status in a nearest floor stoppage operation mode are indicated in "normal, NF" on the "Running mode" row. In this case, the no-entry indicators 17 and 22 provide no indication. The evacuation guidance indicators 18 provide no indirection. The evacuation guidance indicator 28 provides no indication. The use state indicator 23 provides no indication. The report devices 16, 21 and 27 operate normally. For example, when a user is trapped in the car 3, the user can press the intercommunication button 27*a* and communicate with the outside through, e.g., a telephone line by means of the speaker microphone 27*b*.

A status in a signal device operation mode indicates "Alarm" on the "Running mode" row. In this case, the no-entry indicators 17 and 22 indicate that use of the elevator is prohibited. The evacuation guidance indicators 18 indicate that the car 3 can be used for evacuation. The evacuation guidance indicator 28 indicates that the car 3 can be used for evacuation. The use state indicator 23 indicates that the car 3 is in use for evacuation. The report devices 16, 21 and 27 operate normally. For example, when a user is trapped in the car 3, the user can press the intercommunication button 27*a* and communicate with the outside through, e.g., a telephone line by means of the speaker microphone 27*b*.

A status in an evacuation operation mode is indicated in "Fire Warden" on the "Running mode" row. In this case, the no-entry indicators 17 and 22 provide no indication. The evacuation guidance indicators 18 indicate that the car 3 can be used for evacuation. The evacuation guidance indicator 28 indicates that the car 3 can be used for evacuation. The use state indicator 23 indicates that the car 3 can be used for evacuation. The operation of the report devices 16, 21 and 27 is switched to evacuation intercommunication operation. In this case, pressing the intercommunication button 16*a* or the like on any of the rescue floors 4*a* to 4*c*, the evacuation floor 5 and inside the car 3 enables intercommunication among the rescue floors 4*a* to 4*c*, the evacuation floor 5 and the inside of the car 3 using the speaker microphones 16*b* and the like. It is possible to allow intercommunication to be performed among many sites including a building manager room of the building and a machine room of the elevator device.

A status in a forced return operation mode indicates "Call back" on the "Running mode" row. In this case, the no-entry indicators 17 and 22 indicate that use of the elevator is prohibited. The evacuation guidance indicators 18 provide no indication. The evacuation guidance indicator 28 provides no indication. The use state indicator 23 provides no indication. The operation of the report devices 16, 21 and 27 is switched to evacuation intercommunication operation. In this case, pressing the intercommunication button 16*a* or the like on any of the rescue floors 4*a* to 4*c*, the evacuation floor 5 and inside the car 3 enables intercommunication among the rescue floors 4*a* to 4*c*, the evacuation floor 5 and the inside of the car 3 using the speaker microphones 16*b* and the like. It is also possible to allow intercommunication to be performed among many sites including the building manager room of the building and the machine room of the elevator device.

Next, operation of the elevator device will be described with reference to FIGS. 7 to 10.

Figure 7:
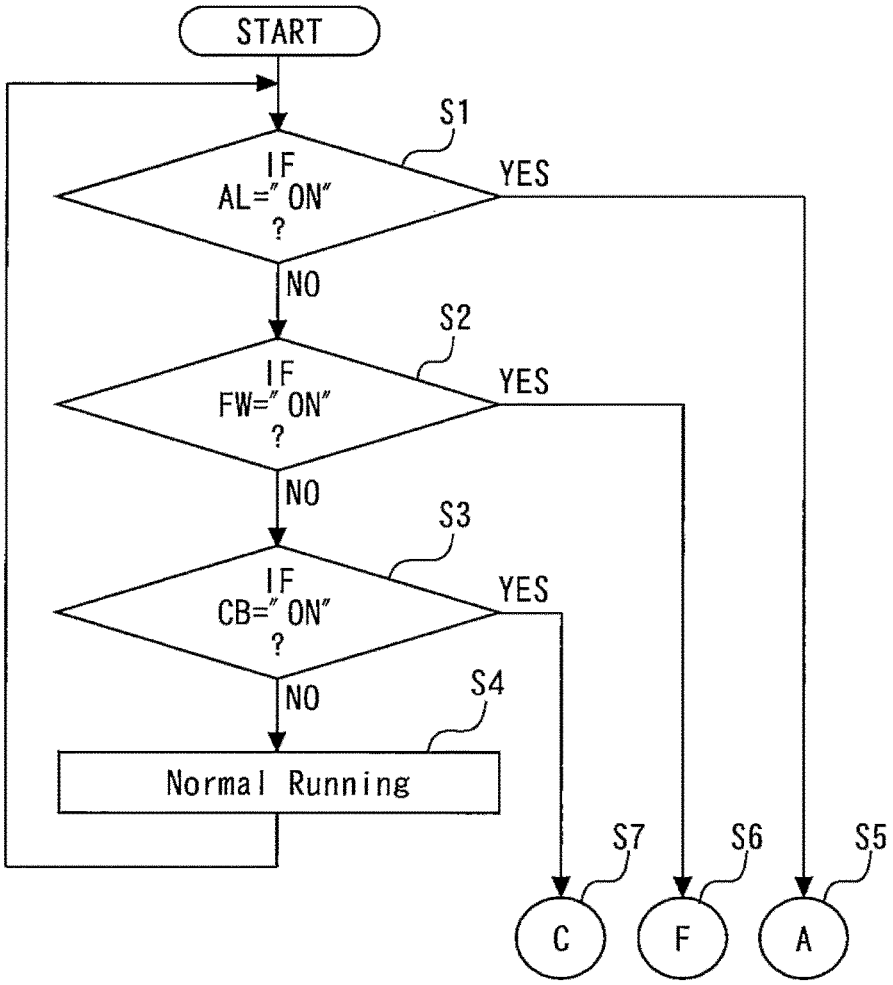
FIG. 7 is a flowchart for describing operation of the elevator device according to Embodiment 1 of the present invention in a normal operation mode.
Figure 8:
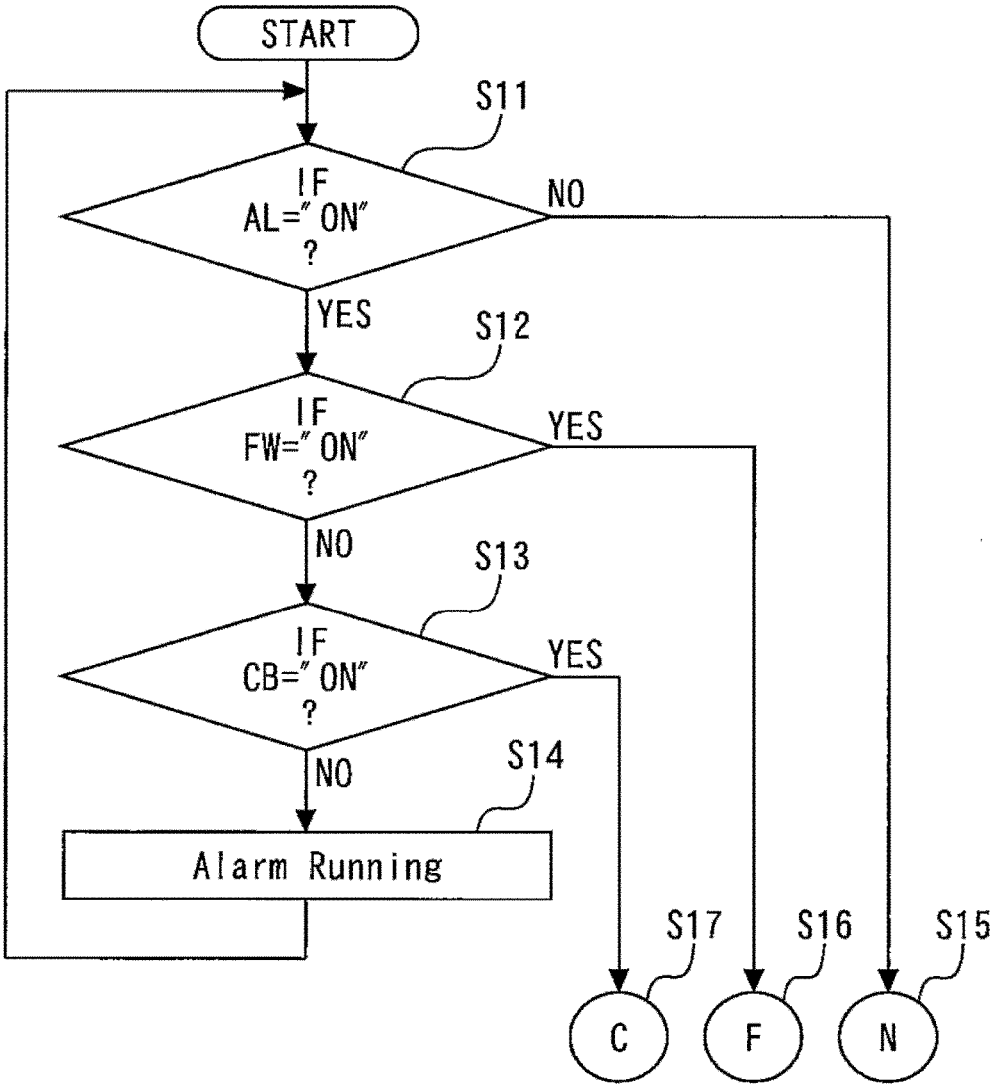
FIG. 8 is a flowchart for describing operation of the elevator device according to Embodiment 1 of the present invention in a signal device operation mode.
Figure 9:
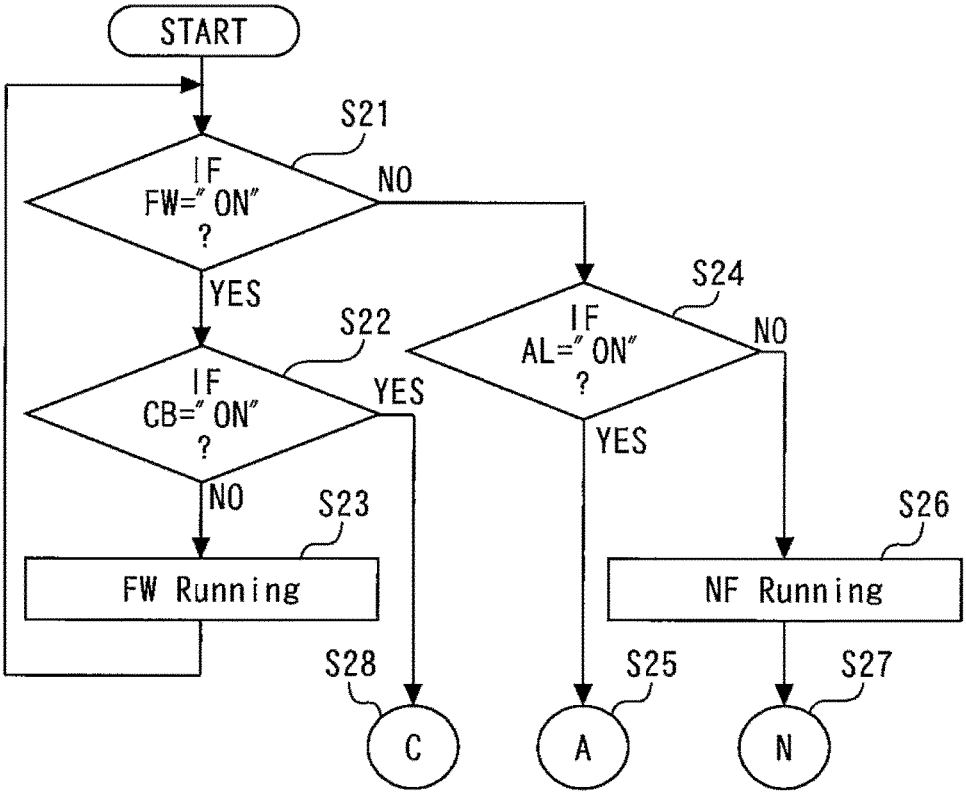
FIG. 9 is a flowchart for describing operation of the elevator device according to Embodiment 1 of the present invention in an evacuation operation mode.
Figure 10:
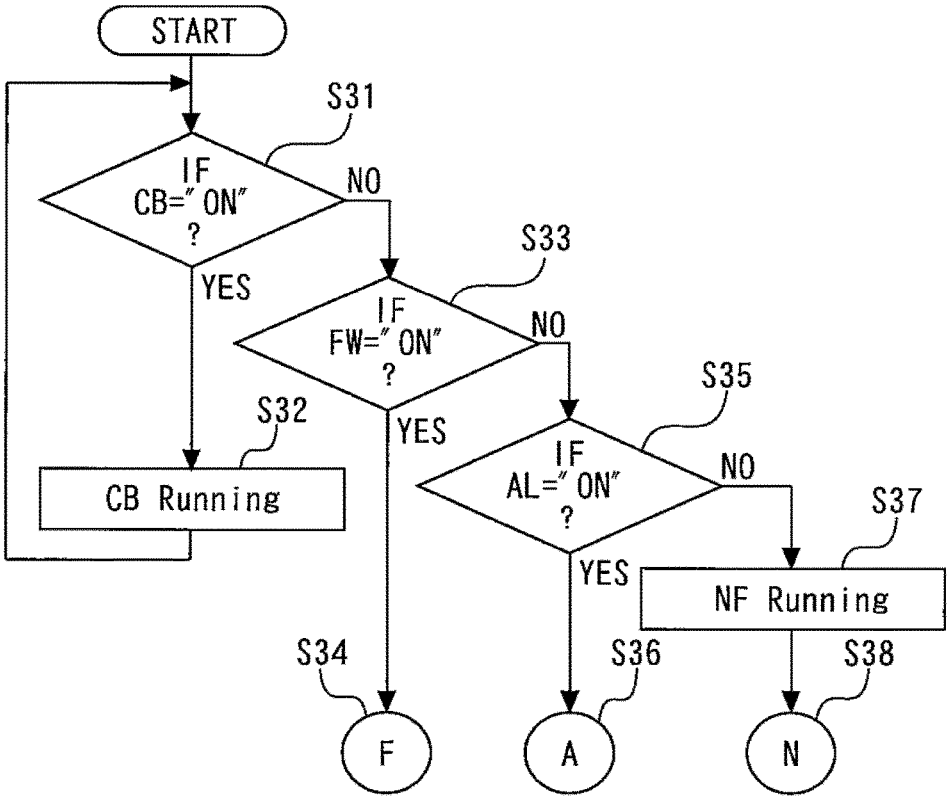
FIG. 10 is a flowchart for describing operation of the elevator device according to Embodiment 1 of the present invention in a forced return operation mode.

FIG. 7 is a flowchart for describing operation of the elevator device according to Embodiment 1 of the present invention in a normal operation mode. FIG. 8 is a flowchart for describing operation of the elevator device according to Embodiment 1 of the present invention in a signal device operation mode. FIG. 9 is a flowchart for describing operation of the elevator device according to Embodiment 1 of the present invention in an evacuation operation mode. FIG. 10 is a flowchart for describing operation of the elevator device according to Embodiment 1 of the present invention in a forced return operation mode.

In FIGS. 7 to 10, actuation of the signal device is indicated by 'AL="ON"'. A state in which an evacuation operation mode request has been made is indicated by 'FW="ON"'. A state in which a forced return operation mode request has been made is indicated by 'CB="ON"'.

In the normal operation mode in FIG. 7, in step S1, the controller determines whether or not the signal device is actuated. If the signal device is not actuated in step S1, the operation proceeds to step S2. In step S2, the controller determines whether or not there is an evacuation operation mode request.

If there is no evacuation operation mode request in step S2, the operation proceeds to step S3. In step S3, the controller determines whether or not there is a forced return operation mode request. If there is no forced return operation mode request in step S3, the operating proceeds to step S4.

In step S4, the controller maintains the normal operation mode. In this case, the controller repeats the determination in step S1 in a preset cycle. Here, the operation may be returned to step S1 by means of an interrupt action.

If the signal device is actuated in step S1, the operation proceeds to step S5. In step S5, the controller changes the operation mode to a signal device operation mode. If there is an evacuation operation mode request in step S2, the operation proceeds to step S6. In step S6, the controller changes the operation mode to an evacuation operation mode. If there is a forced return operation mode request in step S3, the operation proceeds to step S7. In step S7, the controller changes the operation mode to a forced return operation mode.

In the signal device operation mode in FIG. 8, in step S11, the controller determines whether or not the signal device is actuated. If the signal device is actuated in step S11, the operation proceeds to step S12. In step S12, the controller determines whether or not there is an evacuation operation mode request.

If there is no evacuation operation mode request in step S12, the operation proceeds to step S13. In step S13, the controller determines whether or not there is a forced return operation mode request. If there is no forced return operation mode request in step S13, the operation proceeds to step S14.

In step S14, the controller maintains the signal device operation mode. In this case, the controller repeats the determination in step S11 in a preset cycle. Here, the operation may be returned to step S11 by means of an interrupt action.

If the signal device is not actuated in step S11, the operation proceeds to step S15. In step S15, the controller changes the operation mode to a normal operation mode. If there is an evacuation operation mode request in step S12, the operation proceeds to step S16. In step S16, the controller changes the operation mode to an evacuation operation mode. If there is a forced return operation mode request in step S13, the operation proceeds to step S17. In step S17, the controller changes the operation mode to a forced return operation mode.

In the evacuation operation mode in FIG. 9, in step S21, the controller determines whether or not there is an evacuation operation mode request. If there is an evacuation operation mode request in step S21, the operation proceeds to step S22. In step S22, the controller determines whether or not there is a forced return operation mode request.

If there is no forced return operation mode request in step S22, the operation proceeds to step S23. In step S23, the controller maintains the evacuation operation mode. In this case, the controller repeats the determination in step S21 in a preset cycle. The operation may be returned to step S21 by means of an interrupt action.

If there is no evacuation operation mode request in step S21, the operation proceeds to step S24. In step S24, the controller determines whether or not the signal device is actuated. If the signal device is actuated in step S24, the operation proceeds to step S25. In step S25, the controller changes the operation mode to a signal device operation mode.

If the signal device is not actuated in step S24, the operation proceeds to step S26. In step S26, the controller changes the operation mode to a nearest floor stoppage operation mode. In this case, the car 3 temporarily stops at a nearest floor. Subsequently, the operation proceeds to step S27, and the controller changes the operation mode to a normal operation mode.

If there is a forced return operation mode request in step S22, the operation proceeds to step S28. In step S28, the controller changes the operation mode to a forced return operation mode.

In the forced return operation mode in FIG. 10, in step S31, the controller determines whether or not there is a forced return operation mode request. If there is a forced return operation mode request in step S31, the operation proceeds to step S32. In step S32, the controller maintains the forced return operation. In this case, the controller repeats the determination in step S31 in a preset cycle. The operation may be returned to step S31 by means of an interrupt action.

If there is no forced return operation mode request in step S31, the operation proceeds to step S33. In step S33, the controller determines whether or not there is an evacuation operation mode request. If there is an evacuation operation mode request in step S33, the operation proceeds to step S34. In step S34, the controller changes the operation mode to an evacuation operation mode.

If there is no evacuation operation mode request in step S33, the operation proceeds to step S35. In step S35, the controller determines whether or not there is a signal device operation mode request. If there is a signal device operation mode request in step S35, the operation proceeds to step S36. In step S36, the controller changes the operation mode to a signal device operation mode.

If there is no signal device operation mode request in step S35, the operation proceeds to step S37. In step S37, the controller changes the operation mode to a nearest floor stoppage operation mode. Subsequently, the operation proceeds to step S38, and the controller changes the operation mode to a normal operation mode.

According to Embodiment 1 described above, if an evacuation operation mode request switch 15 is kept in an operated state, the car 3 continues movement between the relevant rescue floor and the evacuation floor 5. Here, the car 3 continuously stops at the relevant rescue floor until an evacuation guide member performs a preset operation. Thus, an efficiency of evacuation of a large number of users from the relevant rescue floor can be enhanced. As a result, people left in the building can efficiently be evacuated.

Here, the doors 3*a* and 3*c* are continuously opened until a predetermined operation is performed. Thus, a larger number of users can easily be guided to the car 3.

Also, in each hall 2, a floor number of the relevant rescue floor is indicated. Thus, users in each hall 2 can recognize a hall 2 used for evacuation using the car 3. Here, a direction of movement of the car 3 is also indicated. In other words, in each hall 2, an evacuation operation status is indicated in detail. Thus, chaos during evacuation can be prevented.

Also, in the hall 2 on each rescue floor or inside the car 3, it is indicated that the car 3 can be used for evacuation. Thus, users can evacuate in relief using the car 3.

Also, in the hall of the evacuation floor 5, it is indicated that the car 3 is in use for evacuation. Thus, firefighters can recognize that evacuation guidance using the car 3 is properly performed.

Also, on the rescue floor, the evacuation floor 5 and inside the car 3, the report devices 16 and the like are provided. Thus, evacuation guide members, firefighters and users can communicate with one another. As a result, chaos during evacuation can be prevented.

Also, when the forced return operation mode request switch 20 is operated, the car 3 returns to the evacuation floor 5. Thus, a firefighter can stop or resume an evacuation operation mode depending on the situation.

Also, in a hall on each of floors other than the rescue floors, a no-entry indicator indicating that no entry to the car is allowed in an evacuation operation mode may be provided. In this case, in the halls, users can recognize that users cannot evacuate using the car 3.

Also, a monitor may be provided in each of the report devices 16 and the like. In this case, in a normal operation mode, e.g., information on the inside of the building, promotions and advertisements may be indicated on the monitors. When operation of the report devices 16 and the like is switched to evacuation intercommunication operation, information to be shared for evacuation guidance, by the evacuation guide members 6*a* to 6*c* deployed at a plurality of spots in the building may be indicated on the monitors. For example, an image taken by a camera provided on an evacuation route, a landing entrance of the elevator and the like may be indicated on the monitors. For example, an image of, e.g., an evacuation guide member 6 who is engaging in intercommunication or an image of the periphery taken by a camera provided in the vicinity of a report device 16 or the like may be indicated on the monitors. For example, these images may be indicated on the monitors while the images being automatically switched from one to another.

INDUSTRIAL APPLICABILITY

As described above, an elevator device according to the present invention can be used for a system that lets people left in a building be efficiently evacuated.

DESCRIPTION OF SYMBOLS

1 hoistway, 2 hall, 3 car, 4*a* to 4*c* rescue floor, 5 evacuation floor, 6*a* to 6*c* evacuation guide member, 7*a* to 7*c* evacuee, 8*a* to 8*c* door, 9*a*, 9*b* hall operating panel, 10*a*, 10*b* up button, 11*a* down button, 12*a* to 12*c* position indicator, 13*a* to 13*c* movement direction indicator, 14 evacuation guidance operating panel, 15 evacuation operation mode request switch, 16 report device, 16*a* intercommunication button, 16*b* speaker microphone, 17 no-entry indicator, 18 evacuation guidance indicator, 19 operating panel for firefighters, 20 forced return operation mode request switch, 21 report device, 21*a* intercommunication button, 21*b* speaker microphone, 22 no-entry indicator, 23 use state indicator, 24 car operating panel, 25 operation button, 26 communication device, 27 report device, 27*a* intercommunication button, 27*b* speaker microphone, 28 evacuation guidance indicator, 29*a* to 29*d* block, 30*a* to 30*l* arrow

The invention claimed is:

1. An elevator device comprising:

an evacuation operation mode request switch provided in a hall of an elevator on a rescue floor;

a car that, when the evacuation operation mode request switch is kept in an operated state, keeps operating in an evacuation operation mode in which the car moves between the rescue floor and an evacuation floor; and an operation control device that is provided in the hall of the elevator on the rescue floor and, when the operation control device is operated while the car is stopped at the rescue floor, moves the car to the evacuation floor, wherein the evacuation operation mode request switch and the operation control device are accessible by a user of the elevator device, and wherein the car is operable using the operation control device when the evacuation operation mode request switch is not in the operated state.

2. The elevator device according to claim 1, wherein the operation control device closes a door of the elevator when the operation control device is operated when the car is stopped at the rescue floor.

3. The elevator device according to claim 1, comprising:

a rescue floor indicator that is provided in a hall of the elevator and indicates a number corresponding to the rescue floor on which the evacuation operation mode request switch has been operated; and a movement direction indicator that is provided in the hall of the elevator and indicates a direction of movement of the car.

4. The elevator device according to claim 1, comprising an evacuation guidance indicator that is provided in the hall on the rescue floor or inside the car and indicates that the car can be used for evacuation.

5. The elevator device according to claim 1, comprising a use state indicator that is provided in a hall on the evacuation floor and indicates that the car is in use for evacuation.

6. The elevator device according to claim 1, comprising a first no-entry indicator provided in a hall of the elevator on a floor other than the rescue floor and when the evacuation operation mode request switch is kept in an operated state, indicates that no entry to the car is allowed.

7. The elevator device according to claim 1, comprising respective report devices provided in the hall on the rescue floor and the hall on the evacuation floor and the inside of the car, the respective report devices enabling intercommunication with one another.

8. The elevator device according to claim 1, comprising a forced return operation mode request switch provided in the hall on the evacuation floor, wherein when the forced return operation mode request switch is operated, the car returns to the evacuation floor.

9. The elevator device according to claim 8, comprising respective second no-entry indicators that are provided in the hall on the rescue floor and the hall on the evacuation floor and when the forced return operation mode request switch is operated, indicates that no entry to the car is allowed.

* * * * *